United States Patent [19]

Malinowski et al.

[11] 4,313,322

[45] Feb. 2, 1982

[54] STRAIGHTENING MACHINE FOR METAL PLATE AND STRIP

[75] Inventors: Hans Malinowski; Klaus P. Pielsticker, both of Dusseldorf, Fed. Rep. of Germany

[73] Assignee: Schloemann-Siemag Aktiengesellschaft, Dusseldorf, Fed. Rep. of Germany

[21] Appl. No.: 97,801

[22] Filed: Nov. 27, 1979

[30] Foreign Application Priority Data

Jun. 1, 1979 [JP] Japan ..... 54/6754

[51] Int. Cl.[3] ..... B21D 1/02

[52] U.S. Cl. ..... 72/164; 72/165

[58] Field of Search ..... 72/163-165

[56] References Cited

U.S. PATENT DOCUMENTS

| | | | |
|---|---|---|---|
| 1,890,342 | 12/1932 | Sutton et al. | 72/163 |
| 2,254,461 | 9/1941 | Todd | 72/163 |
| 2,429,142 | 10/1947 | Thomas | 72/163 |
| 2,827,945 | 3/1958 | Maust | 72/163 X |
| 2,852,065 | 9/1958 | Peterson | 72/164 |
| 3,289,448 | 12/1966 | Wiig | 72/164 X |

*Primary Examiner*—Milton S. Mehr

*Attorney, Agent, or Firm*—Holman & Stern

[57] ABSTRACT

A straightening machine has upper and lower sets of straightening rollers, each backed up by back-up rollers. The back-up rollers are mounted on bearing supports. In one set of straightening rollers, the bearing supports extend parallel to the rollers and all the back-up rollers associated with one straightening roller are mounted on a common support. In the other set of straightening rollers, the bearing supports extend at right angles to the rollers, and each support mounts back-up rollers, each of which is associated with a different one of the straightening rollers. Each of the bearing supports can be moved towards or away from the gap between the upper and lower sets of straightening rollers.

7 Claims, 3 Drawing Figures

STRAIGHTENING MACHINE FOR METAL PLATE AND STRIP

BACKGROUND OF THE INVENTION

1. Field of the Invention

The invention relates to a straightening machine for metal plate and strip having an upper and a lower row of straightening rollers.

2. Description of the Prior Art

In a known straightening machine a set of upper straightening rollers are mounted in an upper frame, and the upper frame by means of driven spindles, is vertically displaceably connected to vertical bars of the machine frame. A set of lower straightening rollers are mounted in a lower frame which is pivotally mounted on both sides by means of arc-shaped surfaces on saddles guided between the vertical bars. By means of inclined surfaces the saddles are vertically displaceably supported in the frame on horizontally displaceable wedges. Each of the upper and lower straightening rollers is supported at their crowns by a plurality of back-up rollers. The back-up rollers arranged successively in the travelling direction, of a plurality of straightening rollers are always mounted as a set on bearing supports.

The bearing supports are individually supported on the upper frame and the lower frame, respectively, by means of adjustable wedges. The bending of the straightening rollers can be adjusted commonly by separate vertical displacement of each set of back-up rollers. By rectilinearly lifting and lowering, or by pivoting the lower frame, the lower straightening rollers may be moved together to a position which corresponds to the desired straightening gap.

The construction of these straightening machines with vertically adjustable upper and lower frame necessitates an expensive manner of construction with long bars. Thereby the stiffness of the machine is very low because of the length of the bars and their connection to the upper frame by means of spindles. It is a further disadvantage that in spite of complicated adjusting devices a separate adjustment of the straightening gap between a pair of straightening rollers on opposite sides of the gap is impossible and therefore the straightening gap cannot be varied in every desired manner.

OBJECT OF THE INVENTION

An object of the invention is the provision of a constructionally simpler straightening machine in a more compact and therefore stiffer manner of construction, wherein the straightening rollers can be bent and the width of the gap adjusted under load. Additionally a separate adjustment of the straightening gap between individual mutually oppositely disposed straightening rollers is to be possible.

SUMMARY OF THE INVENTION

According to the invention there is provided a straightening machine for straightening metal plate and strip, the machine comprising: a frame on either side of the machine, cross-members connecting the frames, an upper set and a lower set of straightening rollers arranged between the cross-members to define a gap between them for a workpiece to be straightened, a plurality of back-up rollers spaced along the length of each straightening roller, back-up roller bearing supports, each support supporting a plurality of rollers, wherein each support supporting rollers associated with one of the sets of straightening rollers extends in the direction of material feed through the machine and supports back-up rollers of different straightening rollers, and each support supporting rollers associated with the other of the sets of straightening rollers extends at right angles to the direction of material feed and supports back-up rollers all of the same straightening roller, a displaceable wedge means for moving each of the bearing supports towards the roll gap, and biassing means for biassing the straightening rollers, back-up rollers and bearing supports away from the roll gap against the wedge means.

In this way adjustment against the straightening pressure and bending of the straightening rollers is possible in many ways and is produced with simple operationally reliable adjusting devices. Moreover, adjustment of the straightening gap between individual oppositely disposed straightening rollers becomes possible. Complicated adjusting devices, such as spindles and pivotal saddles are saved. The construction height of the straightening machine is reduced thereby and the stiffness of the machine is improved considerably.

According to a further feature of the invention, the bearings of the straightening rollers are held in the sense of opening the set of straightening rollers, by means of spring buffers attached to the roller seat. Thereby the straightening rollers are in continuous engagement with the support rollers, their position and bending contour being determined by the position of the back-up rollers.

Furthermore, the bearings of the straightening rollers may be received lying side by side in a guide on the roller seat.

The adjusting wedges arranged transversely to the straightening rollers as well as the adjusting wedges arranged parallel to the straightening rollers may be displaceable by means of hydraulic cylinders the loading of which is controllable individually or commonly.

A further advantage is seen according to the invention in the fact that the back-up rollers associated with the individual straightening rollers are mounted on the bearing supports and the bearing combs, respectively, in such a manner that their axes are offset from the vertical plane of the axes of the straightening rollers alternately in the travelling direction of the metal sheet and opposite thereto. Thereby the straightening rollers are guided in a defined manner in a horizontal direction.

BRIEF DESCRIPTION OF THE DRAWINGS

Further features and advantages of the invention will become apparent from the following detailed description, which is given by way of example, of a preferred embodiment of the invention. In the drawings.

DETAILED DESCRIPTION OF THE EMBODIMENT

Figure 1:
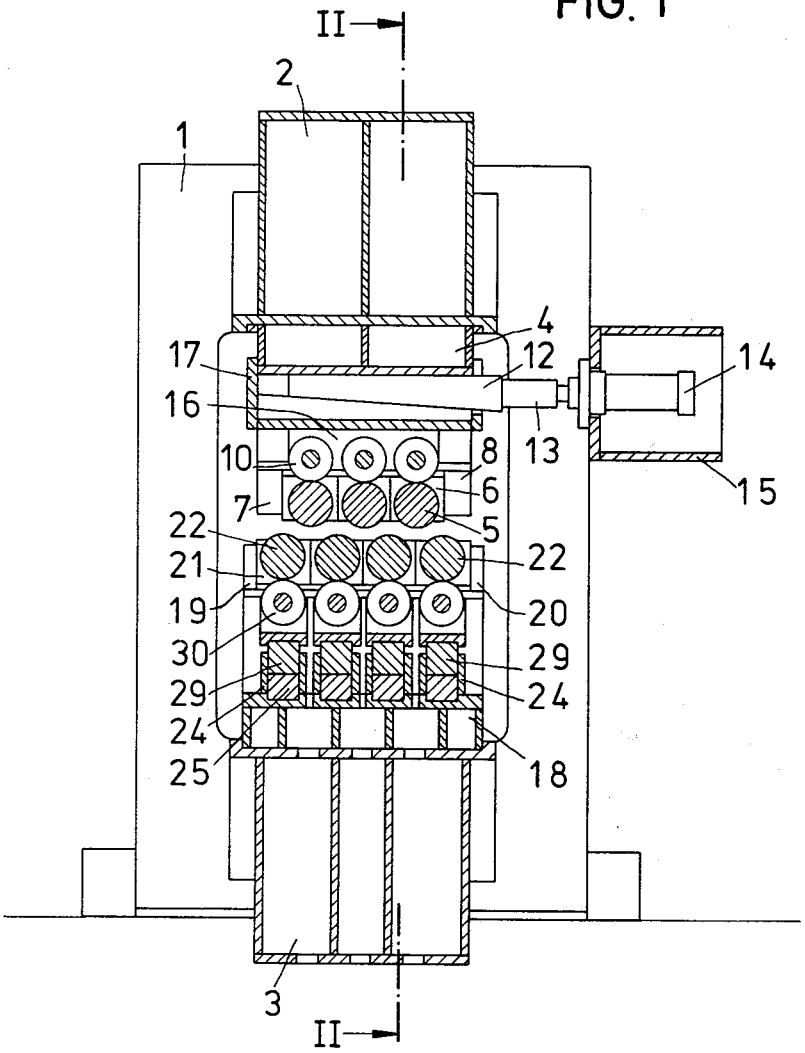
FIG. 1 shows a cross-section through a roller straightening machine.
Figure 2:
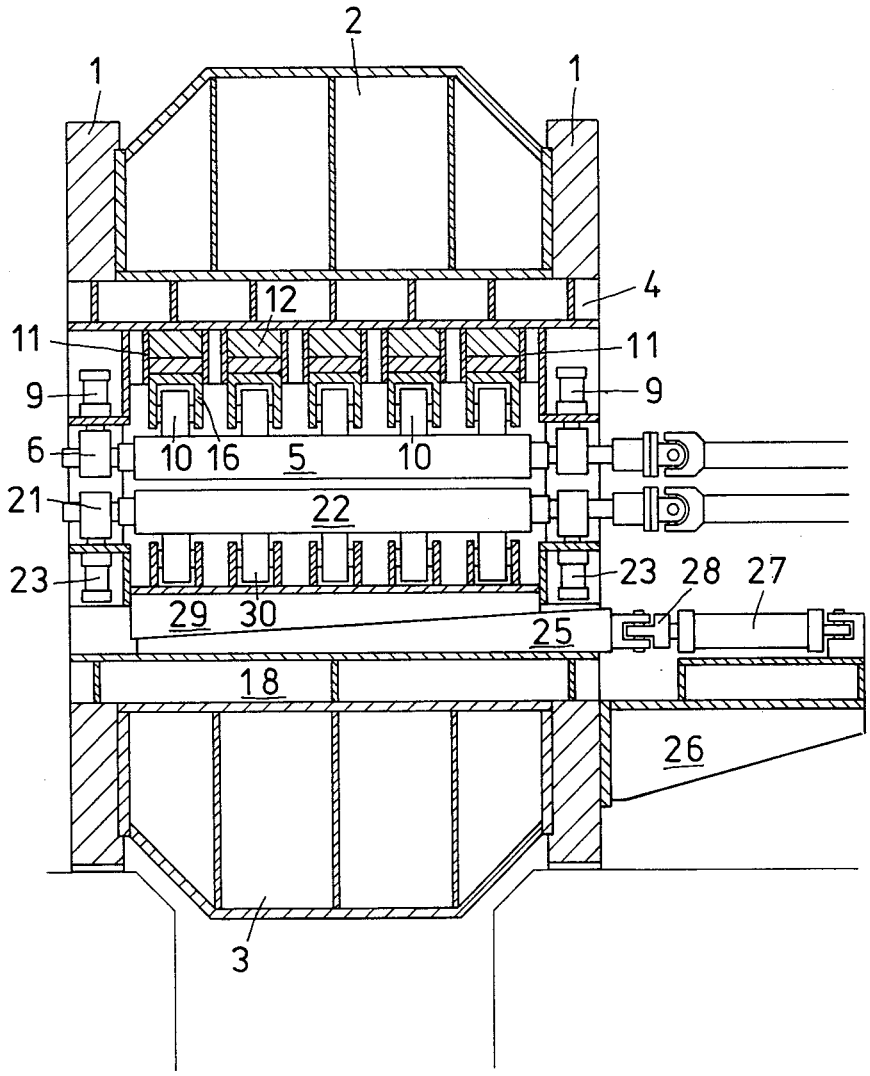
FIG. 2 shows a longitudinal section on the line II—II in FIG. 1.

The frame of the straightening machine illustrated consists of two stands 1 anchored in a foundation and rigidly connected together by an upper cross-member 2 and a lower cross-member 3. An upper roller seat 4 is fixed to the upper cross-member 2 and extends into window openings of the stands 1. Three upper straightening rollers 5 having their bearings 6 in mutually adjacent positions are vertically displaceably mounted in the upper roller seat 4 between guides 7, 8 located in the region of the window openings of the stands. The bearings 6 of the upper straightening rollers 5 are connected to piston rods of spring buffers 9 fixed to the roller seat 4. Each upper straightening roller 5 is supported at its crown by a plurality of back-up rollers 10 arranged side by side.

The upper roller seat 4 comprises guides 11 which extend transversely to the straightening rollers 5 and in which cross-wedges 12 are accommodated. Each cross-wedge 12 is connected by means of a coupling 13 to the piston rod of a hydraulic cylinder 14 which is secured to a support bridge 15. Furthermore, bearing supports 16 are guided in the guide openings 11 in a vertically displaceable manner and lie against and cooperate with the cross-wedges 12. The bearing supports 16 are provided with end plates 17 which are guided on the outer surfaces of the upper roller seat 4. Three back-up rollers 10 which follow each other in the travelling direction of the material to be straightened are mounted on one bearing support 16, and each back-up roller 10 supports one of the straightening rollers 5.

The spring buffers 9 ensure that there is continuous engagement between the straightening rollers 5 and the back-up rollers 10, and between the bearing supports 16 and the cross-wedges 12. For this purpose, however, alternatively separate holder means may be arranged on the upper roller seat 4.

The entire upper row of straightening rollers 5 may be adjusted vertically by common displacement of all cross-wedges 12. For the purpose of obtaining bending of the upper straightening rollers 5 the cross-wedges 12 may be displaced to different positions by separate loading of individual hydraulic cylinders 14, so that the upper back-up rollers 10 form an abutment extending in an arc-shaped manner, for the upper straightening rollers 5.

A lower roller seat 18 is mounted on the lower cross-member 3 and comprises, in the region of the stand openings, lateral guides 19, 20 for the bearings 21 of four lower straightening rollers 22. Each bearing 21 is connected to a spring buffer 23 secured to the lower roller seat 18 and is positively retained on the roller seat 18. The lower roller seat 19 is provided with guides 24 extending parallel to the roller axes, for long longitudinal wedges 25. A plurality of hydraulic cylinders 27 are mounted on a bracket 26 and their piston rods are secured at their ends by means of flexible joint members 28 to the longitudinal wedges 25 for the purpose of individual displacement thereof. Counter-wedges 29 with an inclined underside lie upon the inclined surfaces of the longitudinal wedges 25, and lower back-up rollers 30, each for one lower straightening roller 22, are mounted thereon.

The lower back-up rollers 30 are pressed against the lower straightening rollers 22 by pushing the longitudinal wedges 25 inwardly, whereby each individual straightening roller 22 can be adjusted in the direction of the upper straightening rollers 5 against the holding force of the spring buffers 25. Upon withdrawal of the longitudinal wedges 25 by the hydraulic cylinders 27, the spring buffers 23 and the force of gravity effect the lowering of the lower straightening rollers 22 and back-up rollers 30. By separately loading one of the hydraulic cylinders 27, the straightening gap between two straightening rollers 5 and 22 can be adjusted independently of the straightening gap between the remaining straightening rollers. By commonly loading the hydraulic cylinders 27, all lower straightening rollers 22 can be displaced in common for the purpose of opening the straightening gap.

Figure 3:
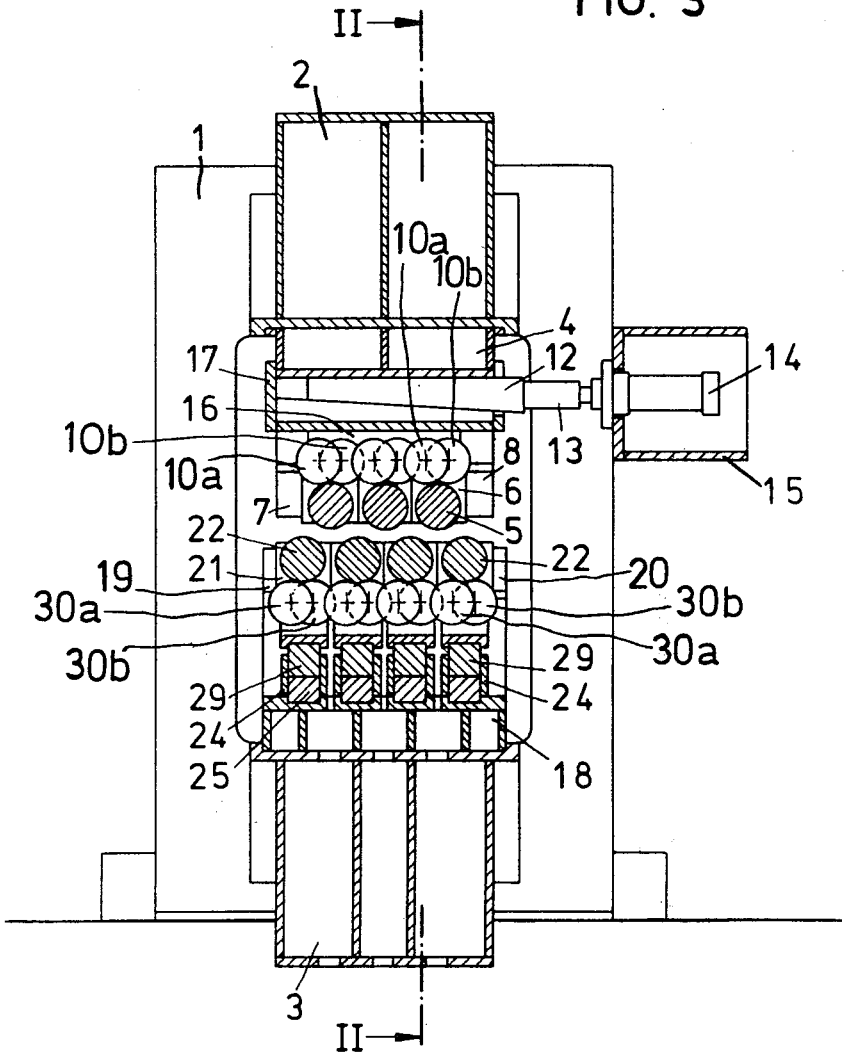
FIG. 3 shows a cross-section through an alternative embodiment of a roller straightening machine.

In the straightening machine of FIG. 3, each straightening roller 5 is supported by back-up rollers 10*a* and 10*b* which are mounted with their axes offset alternately to one side and the other of a vertical plane through the respective straightening roller axis. Each roller 22 is similarly supported by back-up rollers 30*a* and 30*b*.

We claim

1. A straightening machine for straightening metal plate and strip, the machine comprising a frame on either side of the machine, cross-members rigidly connecting the frames, an upper set and a lower set of straightening rollers arranged between the cross-members to define a gap between them for a workpiece to be straightened, a plurality of back-up rollers spaced along the length of each straightening roller, back-up roller bearing supports, each support supporting a plurality of rollers, wherein each support supporting rollers associated with one of the sets of straightening rollers extends in the direction of material feed through the machine and supports back-up rollers of different straightening rollers, and each support supporting rollers associated with the other of the sets of straightening rollers extend at right angles to the direction of material feed and supports back-up rollers all of the same straightening roller, a displaceable wedge means for moving each of the bearing supports towards the roll gap, and biassing means for biassing the straightening rollers, back-up rollers and bearing supports away from the roll gap against the wedge means.

2. The machine of claim 1, including roller seats between the wedge means and the cross-members and connected to the cross-members.

3. The machine of claim 2, wherein said biassing means comprise spring buffers connected between bearings of the straightening rollers and the roller seats.

4. The machine of claim 2, including guides on the roller seats for accommodating the bearings of the straightening rollers.

5. The machine of claim 1, wherein each wedge means comprises pairs of elongate wedges one of which is movable longitudinally relative to the other wedge, to displace said other wedge towards the roll gap, hydraulic cylinders being provided to move the movable wedges either individually or all together.

6. The machine of claim 1, wherein the back-up rollers associated with any one of the straightening rollers are mounted so that their axes are offset alternately to one side or the other of a vertical plane including the straightening roller axis.

7. The machine of claim 1, wherein the back-up rollers associated with each straightening roller are disposed such that a vertical plane passes through each of said straightening rollers and its back-up rollers.

* * * * *